United States Patent [19]

McConville et al.

[11] Patent Number: 5,048,640

[45] Date of Patent: Sep. 17, 1991

[54] WORK PLATFORM SUPPORTED BY STRUCTURAL BEAMS

[76] Inventors: James J. McConville, 1030 N. 31st St.; Allen Jeff, 583 Kirkland Ave., NE., both of Renton, Wash. 98056

[21] Appl. No.: 596,231

[22] Filed: Oct. 12, 1990

[51] Int. Cl.[5] ..... E04G 3/10

[52] U.S. Cl. ..... 182/36; 182/150

[58] Field of Search ..... 182/36, 37, 38, 150, 182/12, 13

[56] References Cited

U.S. PATENT DOCUMENTS

| | | | |
|---|---|---|---|
| 3,159,978 | 12/1964 | DeLillo | 182/36 |
| 3,394,776 | 7/1968 | Abrams | 182/36 |
| 3,465,846 | 9/1969 | Jacobson | 182/36 |
| 3,851,729 | 12/1974 | Gordon | 182/36 |
| 4,163,480 | 8/1979 | Highland | 182/36 |
| 4,200,955 | 5/1980 | Kitchen | 182/36 |
| 4,276,959 | 7/1981 | Barber | 182/150 |
| 4,454,928 | 6/1984 | Marteau | 182/36 |
| 4,570,749 | 2/1986 | McKibbin | 182/36 |

FOREIGN PATENT DOCUMENTS

| | | | |
|---|---|---|---|
| 2612016 | 9/1977 | Fed. Rep. of Germany | 182/36 |

*Primary Examiner*—Reinaldo P. Machado
*Attorney, Agent, or Firm*—Delbert J. Barnard

[57] ABSTRACT

A work platform (10) supported by transverse beams (20) and a pair of elongated side frame assemblies spaced apart by the transverse beams (20) is disclosed. The side frame assemblies (18) include longitudinal beams (28) that support a plurality of axles (32) that support a plurality of rollers (30) with the ends of the axles (32) being supported by the longitudinal beams (28). The rollers (30) provide support for the work platform (10) and allow the work platform (10) to travel along the upper surfaces (34) of lower confronting flanges (16) of work site beams (14), such as are commonly used in bridge construction. The work platform (10) includes lifting arms (66) that serve to raise the rollers (30) up off from the flanges (16) such that the work platform (10) is prevented from travel along the work site beams (14). The transverse frame member (20) includes a member into which a nail can be driven to in that manner allow a deck (22) of wood to be nailed directly to the cross frame members (20). The work platform (10) is lightweight and easily assembled between the work site beams (14) and allows for the use of inexpensive and commonly available materials.

30 Claims, 5 Drawing Sheets

Fig. 1
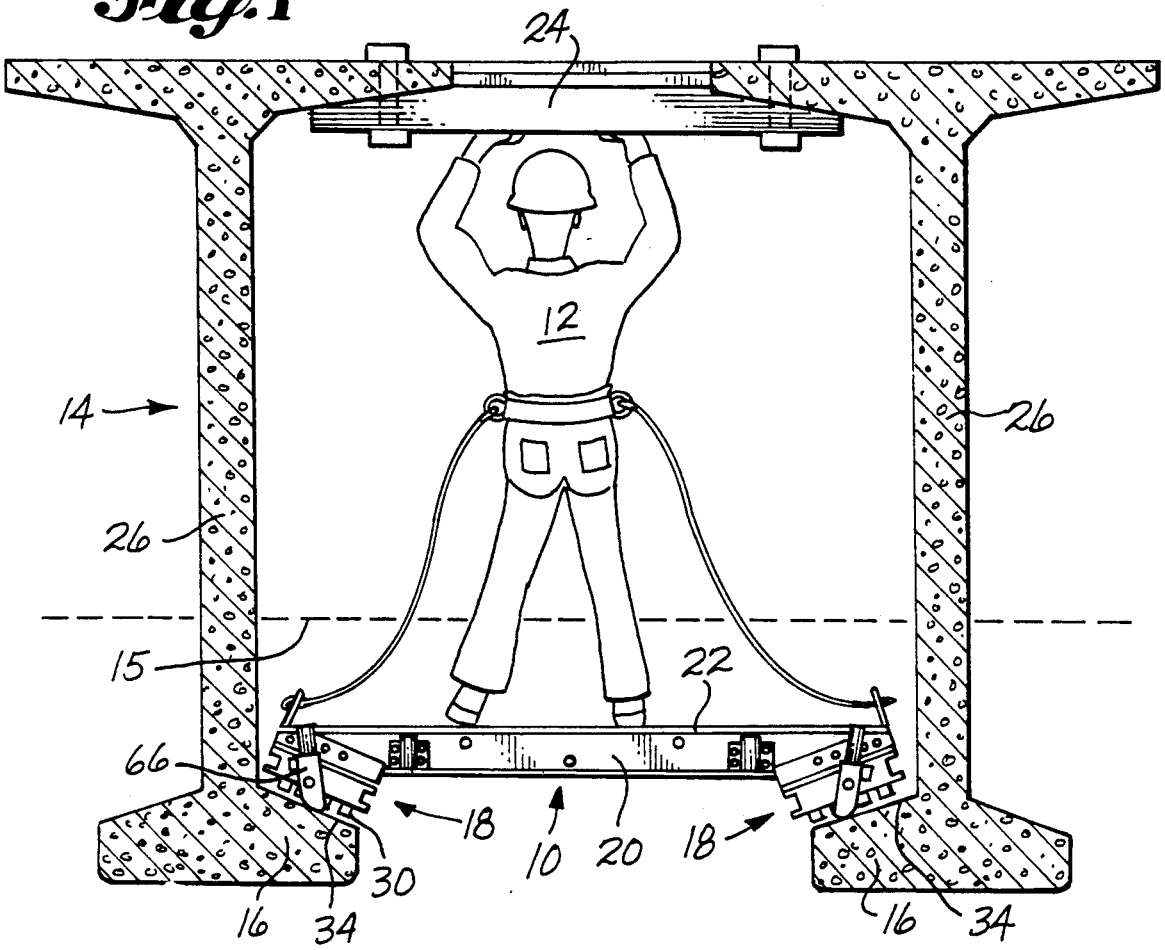
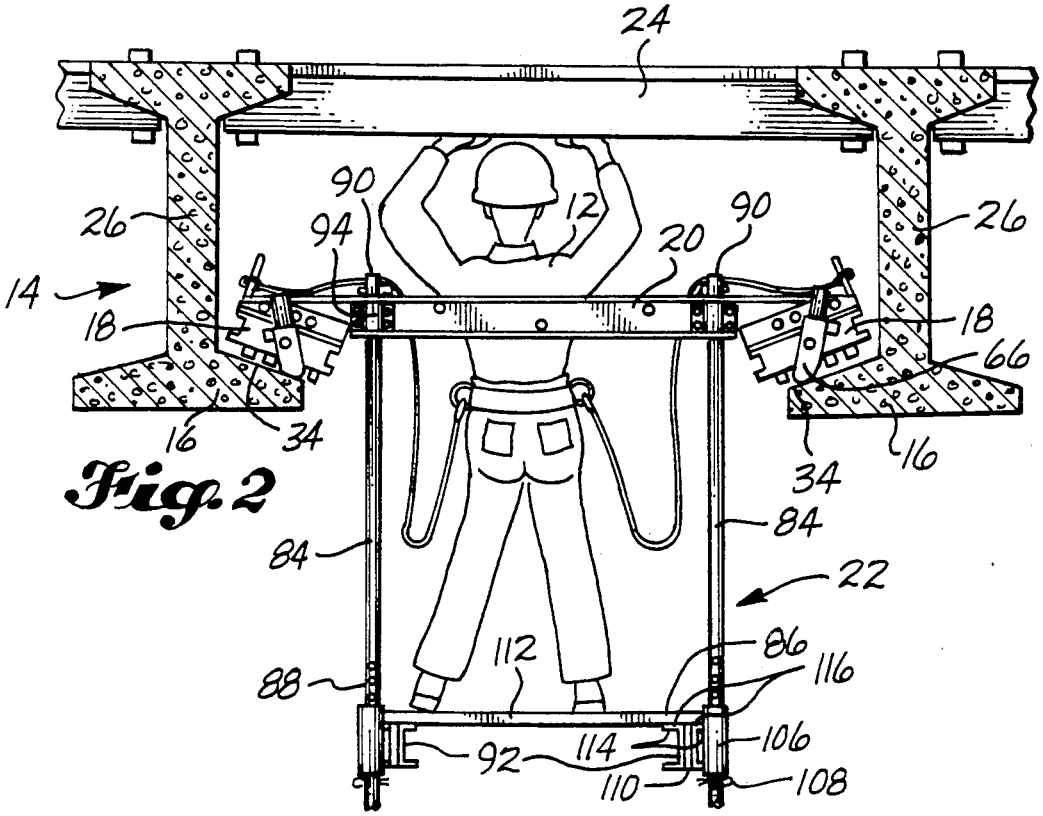
Fig. 2

WORK PLATFORM SUPPORTED BY STRUCTURAL BEAMS

DESCRIPTION

1. Technical Field

The present invention relates to worker supporting work platforms which in use are positioned between and are supported for movement by and along two parallel structural beams in a bridge, building or other work site structure. More particularly, it relates to the provision of a work platform of this type which is basically characterized by a construction which provides a substantial amount of roller contact with lower flanges on the structural beams, and which prevents the platform from falling from a position of support by the structural beams in the event of a connection or roller failure.

2. Background Information

In the construction and maintenance of structures, work is often performed on structural beams, or on a structure supported by such beams. Typically, precast concrete or steel beams are used in the construction of structures such as bridges and buildings. In order to allow a worker to perform required tasks, scaffolding or a movable work platform supported by the ground are typically used to provide the worker with access to the area below or between the work site beams. By way of example, during the construction of a bridge a false deck is constructed between the upper portion of the structural beams. This false deck supports both workers and materials while the bridge deck is being constructed. In order to build the false deck a worker must have access to the area between the structural beams. In addition, a worker may need to place supports for electrical conduit or water piping directly into the structural beams. While performing the work discussed above, a worker generally has to have access to the area between the beams longitudinally of their entire span.

In order to allow construction or maintenance to be performed over the entire span of a beam, a large amount of scaffolding is required, or it must be repeatedly assembled and disassembled, both of which add to the cost of construction. As an alternative a movable scaffolding supported by the ground can be used. However, the ground area underneath the structure being worked upon must be clear, fairly level and smooth. Since many bridges are built over water, use of the above-described scaffolding would be hazardous or impossible due to currents or wave action in the water if a barge is to be used. Another problem with using scaffolding during construction or maintenance of a bridge is that the heighth of the bridge above the ground or water is generally greater than forty feet. In the case of maintenance to the underside of a bridge, stationary scaffolding may impede the use of the road beneath the bridge to be worked upon.

One known arrangement for supporting a scaffolding deck from a beam is disclosed by U.S. Pat. No. 3,851,729, granted Dec. 3, 1974, to Arnold Gordon. Gordon U.S. Pat. No. 3,851,729 discloses a scaffold structure that is adapted to be positioned between a pair of spaced apart I-beams. The beams are a portion of a structure, such as a bridge, building or the like. The platform is supported by four rollers, two at each end of the platform. The four rollers contact the upper surfaces of inwardly directed flanges at the bottoms of the beams. The rollers are mounted on axles which are carried by the upper portion of a frame. The frame supports a deck which is offset below the rollers. The rollers mount the frame and deck for movement lengthwise of the beam, enabling workers to stand on the deck and perform work on the structure of which the beams are a part.

Another known arrangement for supporting scaffolding below a beam is U.S. Pat. No. 4,200,955, granted May 6, 1980, to Roger M. Kitchen and Dennis Braitwaite. Kitchen et al. U.S. Pat. No. 4,200,955 discloses a roller fitting which can be used to suspend a work platform below a girder or beam. Kitchen et al. U.S. Pat. No. 4,200,955 uses a right angled member having a flange contacting roller on one end and a clamp on the other end by which it is connected to a top frame member on the work platform. The flange contacting rollers contact flange members of different beams. The work platform frame supports a deck below the beams.

An object of the present invention is to provide an improved platform of the general type disclosed by Gordon U.S. Pat. No. 3,851,729 and Kitchen et al. U.S. Pat. No. 4,200,955. A principal object of the present invention is to provide a support roller arrangement that is adaptable for use with beams having an angled upper surface of their lower flange portions. Another object of the present invention is to increase the safety aspect of this type of work platform.

DISCLOSURE OF THE INVENTION

A work platform constructed according to the present invention is adapted to be supported by and between a pair of spaced apart work site beams which have inwardly directed confronting flanges. The platform is basically characterized by a pair of elongated, laterally spaced apart side frame assemblies. Each side frame assembly includes a pair of spaced apart longitudinal beams. A plurality of rollers are positioned between the longitudinal beams and are supported for rotation about parallel axes spaced apart longitudinally of the assembly. Transverse frame members extend between and interconnect the side frame assemblies. A worker support structure is connected to the transverse frame members. In use, the side frame assemblies are positioned above the inwardly directed flanges of the work site beams, with their rollers in platform supporting contact with the upper surfaces of the flanges. The rollers mount the work platform for travel along the flanges, lengthwise of the work site beams, for in this manner moving the worker support structure lengthwise of the work site beams.

In preferred form, the rollers have a diameter which is closely equal in dimension to the depth of the longitudinal beams, perpendicular to the upper surfaces of the work site beam flanges, and the rollers are mounted so as to present peripheral portions below the longitudinal beams. This feature permits the construction of side assemblies which are relatively stiff in the vertical direction while at the same time having a relatively small vertical dimension.

In preferred form, the transverse frame members are longer than the open space that is defined by and between the inner edges of the confronting flanges of the work site beams. The end portions of the transverse frame members are connected to the side frame assemblies at locations over the flanges of the work site beams, laterally between a flange edge and the web of the work site beam. Accordingly, if one or more of the connections should fail, or if there is a failure of one or more of the rollers, the platform will not fall because the transverse frame members are prevented from moving vertically downwardly through the open space between the work site beam flanges.

According to a feature of the invention, a worker support deck can be secured to upper portions of the transverse frame members. Or, a suspension frame may be connected at its upper ends to the transverse frame members and at its lower ends be connected to a worker supporting deck, which is offset below the work site beams. Another aspect of the invention is to provide deck supporting beams into which nails can be driven. In preferred form, these beams are composed of a pair of channel beam members having inwardly directed parallel webs and outwardly directed flanges, and a wood member positioned between the webs.

Another feature of the invention is to provide a work platform that is supported by a pair of laterally spaced apart carriages, each including a plurality of rollers, and to interconnect the carriages by transverse frame members which are connected at their ends to the carriages, at fail-safe locations. One or more of the connections can fail and the platform will remain supported by the flanges of the work site beams. In preferred form, the connections are pivotal connections, allowing the carriages to automatically assume a position placing the rollers into contact with the upper surfaces of the work site beam flanges.

Another feature of the invention is to provide a work platform which is supported for movement lengthwise along the space between a pair of spaced apart work site beams, by rollers which make contact with the upper surfaces of confronting lower flanges on said beams, and which includes means engageable for holding the work platform from travel along the flanges of the work site beams. In preferred form, the means engageable may comprise at least one lifting lever which is pivotally attached to the work platform and is movable between an inoperative position in which the rollers are down on the flange and an operative position in which it bears against the work site beam flange and lifts rollers up off from the flange.

Other features, objects and advantages of the invention are hereinafter described in the description of the best mode or preferred embodiment of the invention.

BRIEF DESCRIPTION OF THE DRAWINGS

In the drawings, like reference characters designate like parts the several views, and:

FIG. 1 is an end elevational view of a work platform supported by and between a pair of work site beams, e.g. bridge beams, with the, work site beams shown in cross-section, showing a workman standing on the platform and installing falsework overhead;

FIG. 2 is a view like FIG. 1, showing the work platform modified so as to provide a deck spaced below the work site beams, and also showing a workman standing on the lowered deck and work overhead;

BEST MODE FOR CARRYING OUT THE INVENTION

Figures 3, 13:
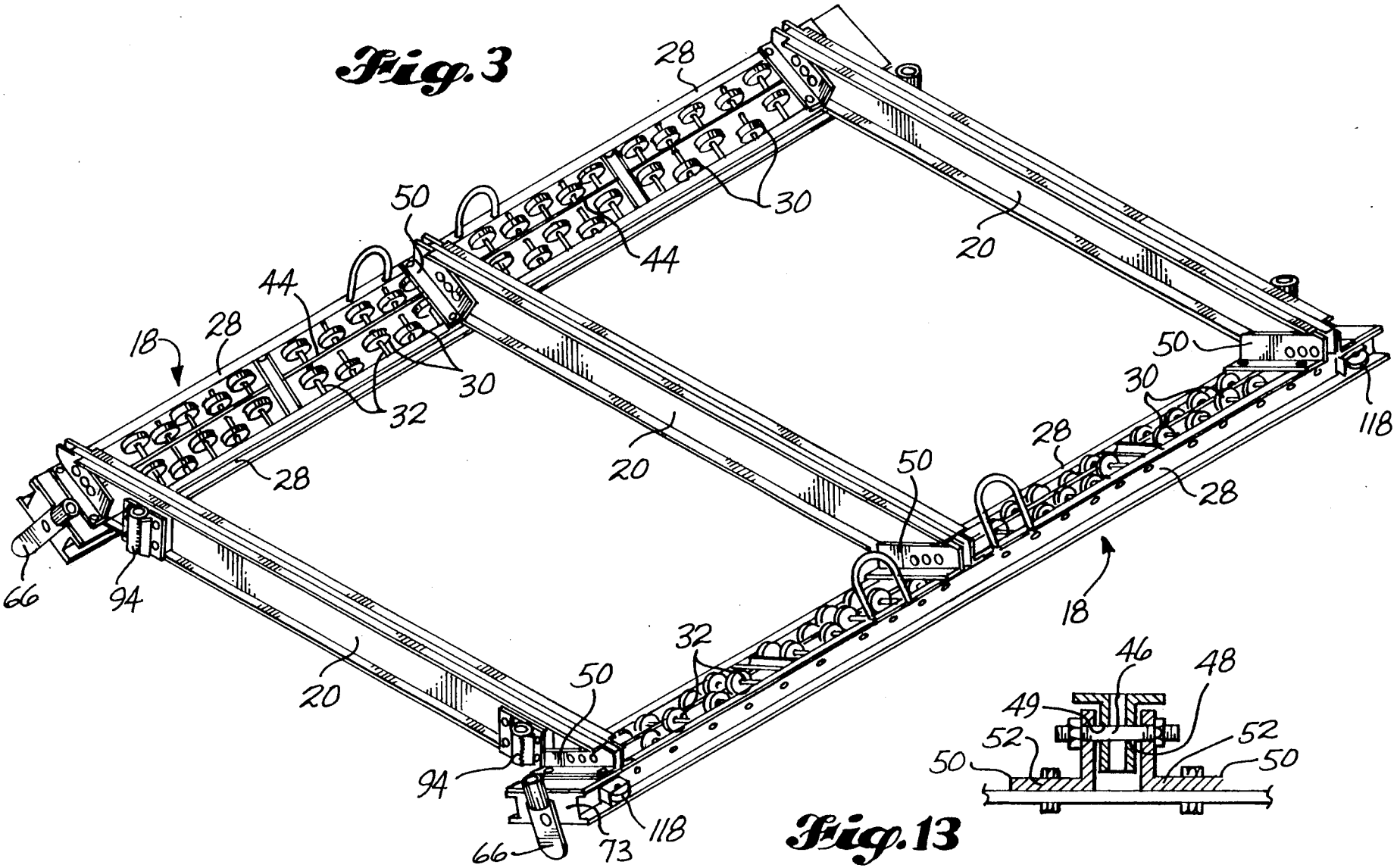
FIG. 3 is a pictorial view of the preferred embodiment of the present invention, taken from above and looking towards one side and an end of the work platform, and showing the general relationship of the side frame assemblies, or roller carriages, and the connecting transverse frame members.
Figure 4:
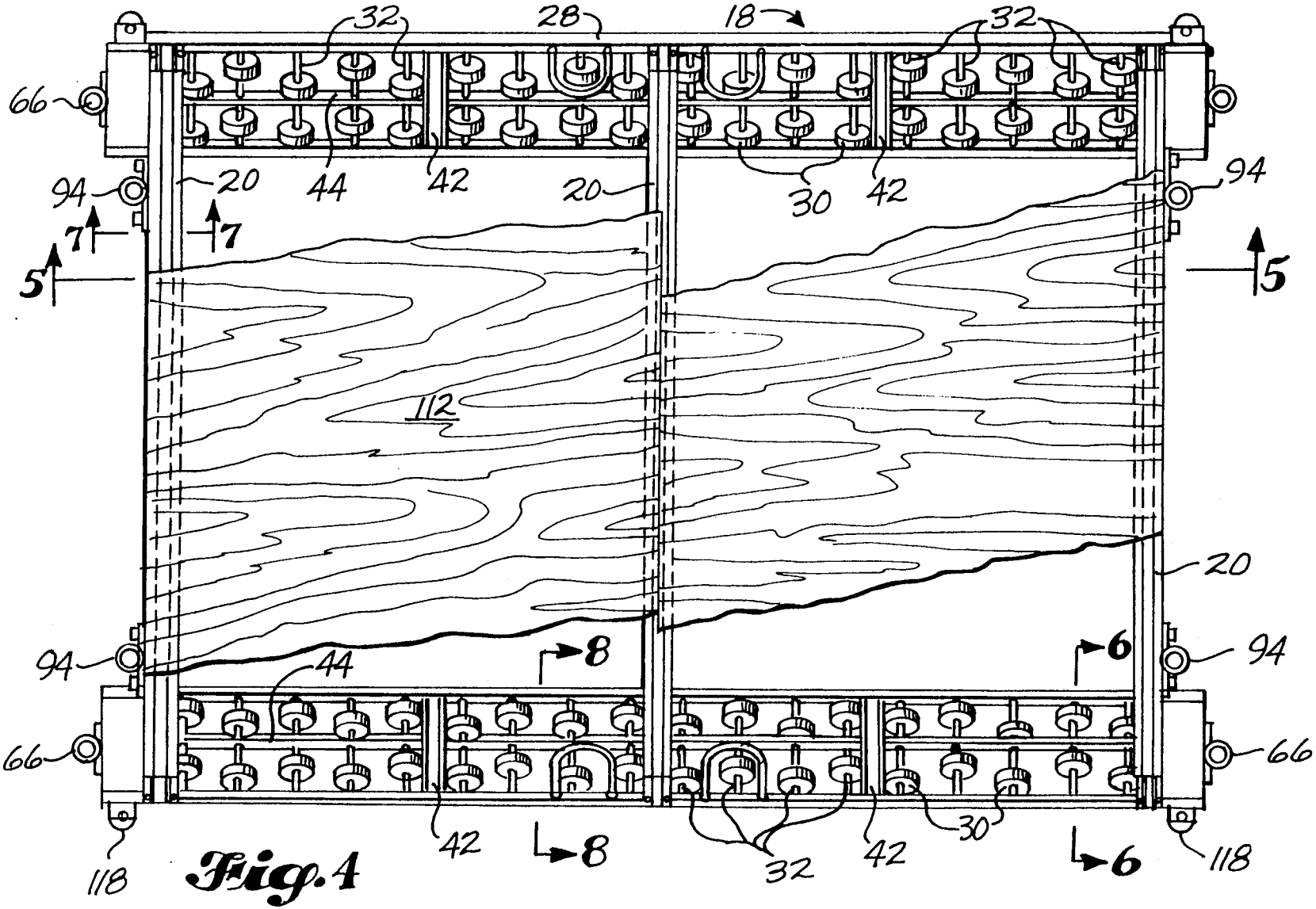
FIG. 4 is a plan view of the work platform shown by FIG. 3, with of the decking cut away to better illustrate the side frame assemblies.

Referring now to the several figures of the drawing, and first to FIG. 1, the work platform 10 is shown supporting a worker 12 and itself supported by a pair of structural beams 14, e.g. concrete "I" beams. Beams 14, hereinafter also referred to as the work site beams, include inwardly directed lower confronting flanges 16. The work platform 10 includes a pair of side frame assemblies 18 which are sometimes hereinafter referred to as carriages. The side frame assemblies 18 are interconnected by transverse frame members 20, the number and spacing of which can vary. As can be seen in FIG. 3, the side frame assemblies 18 are spaced apart by the transverse frame members 20. The transverse frame members 20 provide support for the worker support structure 22, as shown in FIGS. 1 and 2. By way of example, the work platform 10 may hold the worker 12 in a position to assemble a false deck 24 that is used to construct a permanent deck above the work site beams 14.

As can be seen in FIGS. 1 and 2, work site beams 14 may have webs 26 of varying depth. The worker support structure 22 may be placed above the transverse frame members 20 if the web 26 of the work site beam 14 is of sufficient depth to allow the worker 12 to stand, as shown in FIG. 1. On the other hand, if the web 26 of the work site beam 14 is of a smaller depth, as shown in FIG. 2, the worker support structure 22 can be suspended underneath the transverse frame members 20.

Each of the side frame assemblies 18 includes a pair of spaced apart longitudinal beams 28. A plurality of rollers 30 are supported for rotation about parallel axes by a plurality of parallel axles 32 that are in turn supported at their ends by the longitudinal beams 28. The rollers 30 are hereinafter sometimes referred to as wheels. The side frame assemblies 18 are constructed from, or in a manner like, skate wheel conveyors.

Referring now to FIGS. 1-3, the side frame assemblies 18 are positioned above the inwardly directed flanges 16 of the work site beams 14 with the rollers 30 in platform supporting contact with the upper surfaces 34 of the flanges 16. The rollers 30 allow the work platform 10 to travel along between the work site beams 14 while being supported by upper surfaces 34 of the flanges 16, thereby allowing the worker support structure 22 to travel along with the worker 12 longitudinally of the entire span of the work site beams 14.

Figure 8:
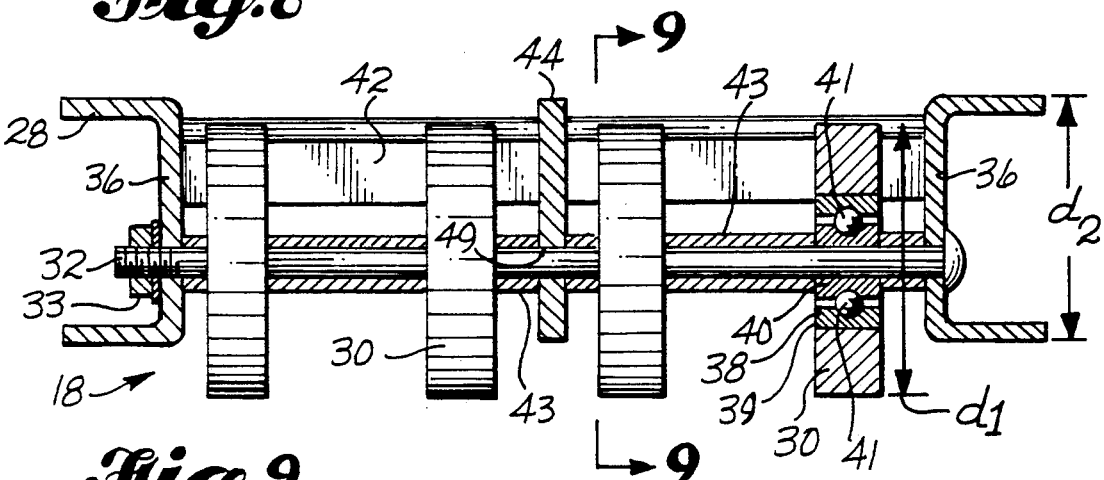
FIG. 8 is an enlarged scale sectional view taken substantially along line 8—8 of FIG. 4, showing the roller support of four rollers in elevation.

As shown in FIG. 8, the rollers 30 have a diameter d1 that is generally equal to the height d2 of a web portion 36 of a longitudinal beam 28. As hereinafter described, the rollers 30 are mounted in such a manner as to present peripheral portions extending below the longitudinal beams 28.

Figure 9:
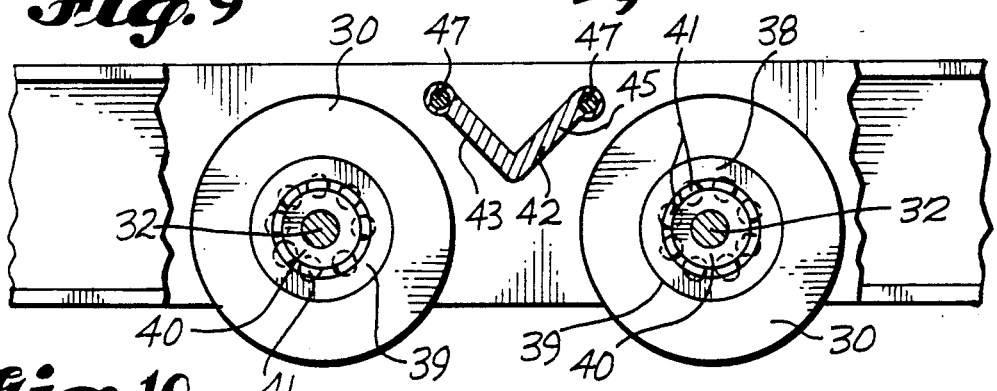
FIG. 9 is an enlarged scale fragmentary sectional view taken substantially along line 9—9 of FIG. 8 showing a stiffener member in cross section and two rollers and beam portions in side elevation.

As shown in FIG. 8, each of the rollers 30 is supported for rotation about each axle 32 by an antifriction bearing 38 which may be a hub portion of the roller. Referring to FIGS. 8 and 9, the anti-friction bearing 38 includes an outer race 39 and an inner race 40. An interference fit is used to attach the outer race 39 to the roller 30. The inner race 40 has an inside diameter sized to closely fit around the axle 32, but is not an interference fit. An array of ball or roller bearings 41, or the like, are located between the outer race 39 and the inner race 40. The inner race 40 is held against rotation by tubular spacers 43. The tubular spacers 43 are placed on the axles 32 and at their ends contact the inner race 40 of the bearings 38 to hold the rollers 30 transversely apart. The spacers 43 separate the rollers 30 from each other and from the longitudinal beams 28. In a preferred embodiment, two rollers 30 are spaced apart a predetermined distance on each axle 32 by tubular spacers 43. The tubular spacers 43 are thin walled tubes that fit closely around the axles 32. The spacers 43 are sized so as to apply pressure to the inner races 40 of the bearings 38 when axle nut 33 is tightened to tension the axle 32.

Figure 7:
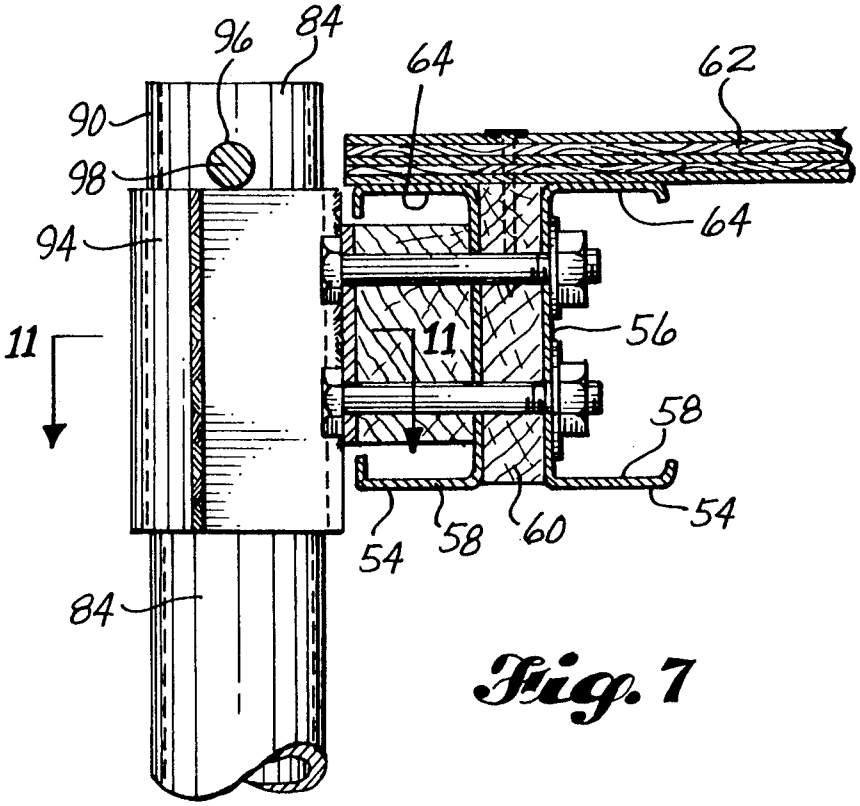
FIG. 7 is an enlarged scale sectional view of one of the transverse frame members, taken substantially along line 7—7 of FIG. 4, showing a socket member and its attachment bolts in elevation.

Referring now to FIG. 7, in preferred form, the transverse frame members 20 include a pair of metal channel members 54 having a web portion 56 oriented in a vertical direction with their flange portions 58 directed away from each other. Sandwiched between the web portions 56 of the channels 54 is a nailable member 60. The nailable member 60 is typically a piece of wood that is held in place by bolts passing through it and the two webs of the two channel members 54. In preferred form, the worker support structure 22 has a deck 62 made-up of plywood paneling, or the like. The deck 62 may be nailed directly to the nailable member 60. The channel members 54 have an upper flange 64 that supports the deck 62 in conjunction with the nailable member 60.

Figure 6:
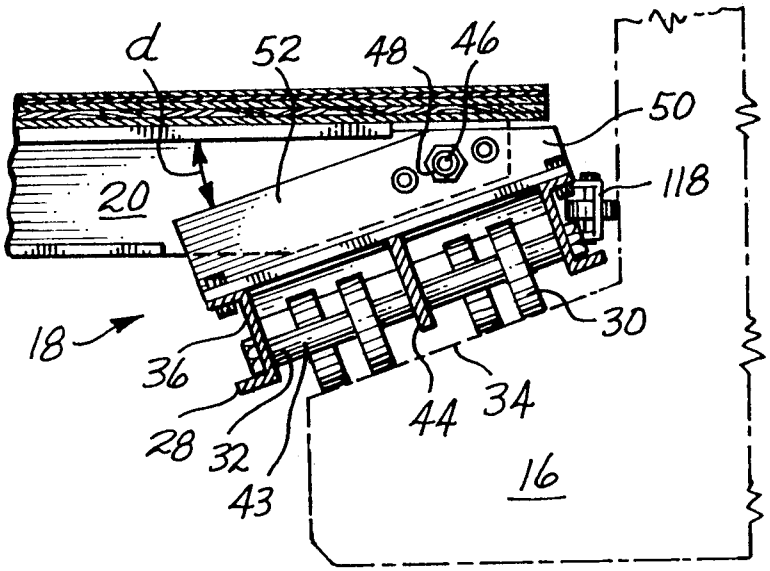
FIG. 6 is an enlarged scale fragmentary sectional view taken substantially along line 6—6 of FIG. 4, showing the work site beam shown in phantom.

Referring now to FIG. 6, a web portion 36 of each longitudinal beam 28 extends substantially perpendicular to the upper surface 34 of the work site beam flange 16 with the axles 32 having their ends connected to longitudinal beam 28 webs 36. Due to the vertical orientation of the webs 36 in the side frame assemblies 18, the side frames 18 exhibit longitudinal stiffness while remaining compact in size. This is important because in some installations cell walls or diaphragms 15 (shown in phantom in FIG. 1) are formed perpendicularly between the beams 14. The diaphragms 15 strengthen the work beam webs 26 and usually extend downwardly to within approximately fourteen inches of the flanges 16. It is important that the side frame assemblies 18 are compact enough to allow the work platform to pass underneath the diaphragms 15, while they remain longitudinally stiff to provide a stable and safe frame for the worker support structure 22.

Figure 5:
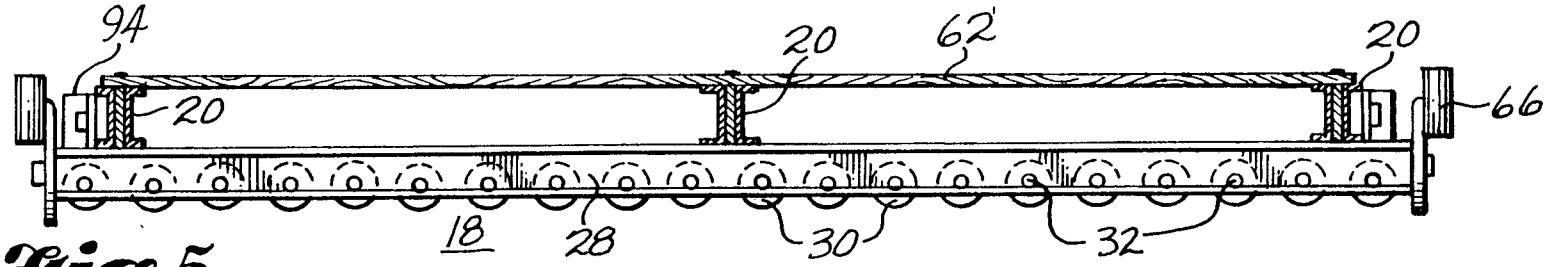
FIG. 5 is a longitudinal sectional view taken substantially along line 5—5 of FIG. 4.

Referring to FIGS. 5 and 8, the axles 32 are connected to the longitudinal beam 28 webs 36 at a point below the center of the web 36. This downward offset of the axles 32 allows the wheels 30 to present a peripheral portion that extends below the longitudinal beams 28. The downward offset of the axles 32 also contributes to the low profile or compactness of the side frame assemblies 18 As discussed above, the compactness of the side frame assemblies 18 is important since it allows them to pass below the diaphragms 15.

As shown in FIGS. 8 and 9, each side frame assembly 18 has a transversely mounted stiffener 42 placed approximately every three feet between each pair of longitudinal beams 28 in order to reinforce the side frame assemblies 18. The stiffener 42 is hereinafter sometimes referred to as a cross frame member. The cross frame member 42 is connected at its ends to the longitudinal beams 28. This connection can be made by either welding or bolting the cross frame member to a longitudinal beam 28 web 36 depending on which material the stiffener 42 is made of. In some installations, the stiffener 42 is made of steel which can be welded directly to the web 36. In other installations, the stiffener 42 is made from aluminum. An aluminum stiffener 42 is illustrated. It is in the nature of an angle iron having legs 43, 45 separated by a 90° angle. The free edges of the legs are tubular. The aluminum stiffeners 42 are bolted to the longitudinal beams 28 by passing bolts through openings in the webs 36 and through the tubular portions 47. The aluminum stiffener 42 may be formed from sheet material that is bent to the desired angle and then has the tubular portions formed by rolling the ends of the legs back upon themselves.

As shown in FIG. 8, each side frame assembly 18 includes a central longitudinal frame member 44 that extends the full length of the side frame assembly 18. Each member 44 includes an opening 49 for each axle 32, through which the axle extends (e.g. FIG. 8). The longitudinal frame member 44 is located between a pair of longitudinal beams 28 and engages the axles 32 thereby providing intermediate support for them. Frame member 44 may be a flat metal bar. The longitudinal frame member 44 is held in position transversely between the wheels 30 of an axle 32 by the tubular spacers 43. In the preferred embodiment having two wheels 30 per axle 32, there are four spacers 43, one each on either side of the wheels 30 and the frame member 44 is between the two inner spacers 43.

As shown in FIGS. 6 and 13, pivot connectors are used to connect each side frame assembly 18 to each transverse frame member 20. Each side frame assembly 18 is pivotably attached to the transverse members 20 by a transverse pivot pin 46. Each transverse member 20 includes an end portion having a transverse pivot pin receiving opening 48. As best shown in FIG. 13, the transverse members 20 have their lower end portions cut away to provide a shallower vertical dimension below the transverse pivot pin receiving opening 48. The side frame assemblies 18 each include a frame portion having a pivot pin receiving opening 49. In preferred form, the frame portions 50 are made from a pair of frame arms 52, which in some installations are made from pieces of angle iron. The frame arms 52 have their horizontal legs bolted to each longitudinal beam 28 of a side frame 18. The pair of frame arms 52 are spaced apart to receive the end portions of the transverse members 20, as shown in FIG. 13.

The pivot pin receiving openings 48 of the transverse members 20 are alignable with the transverse pivot pin receiving openings 49 of the frame arms. A pivot pin 46 is then placed through the pivot pin receiving openings 48, 49 thereby pivotably connecting the transverse members 20 and the side frame assemblies. In some installations, the frame arms 52 have a series of transverse pivot pin receiving openings 49 thereby allowing the transverse span of the work platform 10 to be adjustable according to the work site beam 14 spacing.

The pivotable connection between the transverse members 20 and the side frame assemblies 18 allows the side frames 18 to freely rotate about an axis extending longitudinally of the work platform 10 such that the side frames 18 are free to match the surface angle of the upper surface 34 of the lower work beam flange 16 thereby placing the rollers 30 in contact with the upper surface 34.

Figure 12:
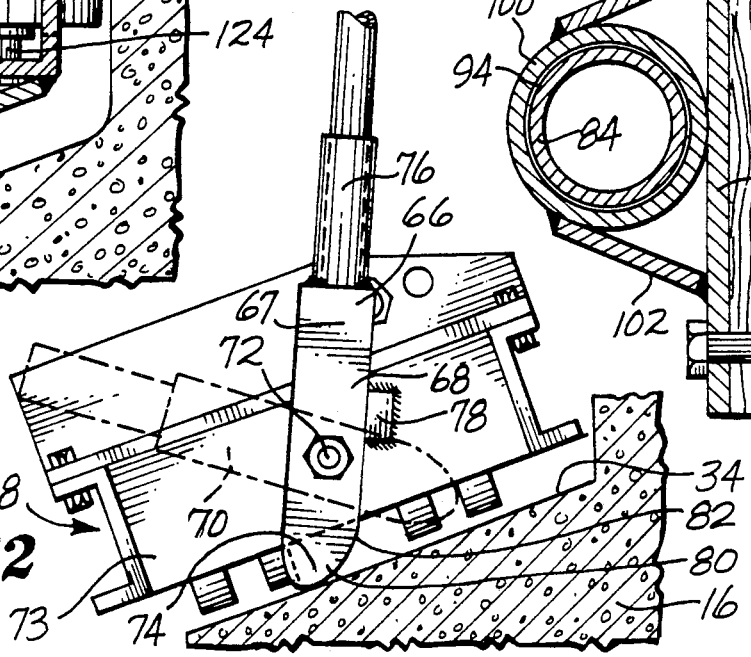
FIG. 12 is an end elevational view of a side frame assembly, including a solid line showing of a platform lifting arm in an operative position and a phantom line showing of such arm in an inoperative position.

Referring now to FIG. 12, each side frame assembly 18 includes a means engageable to prevent the work platform 10 from travel along the flanges 16 of the work site means 14. In a preferred embodiment, a lifting lever 66 is located at each end of each side frame assembly 18. Each lifting lever 66 is pivotably attached to each side frame assembly 18. The lifting lever 66 has an engaged position 68 and a disengaged position 70, as shown in FIG. 12. In the engaged position 68, the lifting lever bears against the work site beam flange 16 thereby lifting the rollers 30 up off from the upper surface 34 of the flange 16. In the disengaged position 70, the lifting lever 66 is rotated or pivoted to a position where it does not bear against the work site beam flange 16 thereby placing the rollers 30 in contact with the upper surface 34 of the flange 16, thereby enabling the work platform 10 to travel along between the work site beams 14.

Each lifting arm 66 includes a pivot connection 72 pivotably attaching the lifting arm 66 to each side frame assembly 18. The pivot connection 72 may be a pivot pin or bolt inserted through a hole drilled in the arm 66 and in an end plate 73. The lifting arm 66 includes a cam portion 74 located between the pivot connection 72 and the flange 16. The control portion 76 of the arm 66, located on the opposite side of the pivot connection 72 from the cam 74, is used to rotate the lifting arm 66. In preferred form, the control portion 76 of the arm 66 is formed from a tube such that a smaller diameter tube or bar can be placed therein in order to gain more leverage for rotating the arm 66. Each side frame assembly 18 also includes a stop 78 that a blade portion 67 of the lifting arm 66 moves against when the lifting arm 66 is in its engaged position 68. The cam portion 74 includes a cam surface 80 which is in lifting contact with the upper surface 34 of the flange 16 during a portion of the movement of the lifting arm 66 from its disengaged position 70 to its engaged position 68 (see FIG. 12). After moving across the cam surface 80 the lifting arms 66 hold each side frame assembly 18 up off from the flange 16 on a holding surface 82 that is adjacent the cam surface 80. The holding surface 82 and the stop 78 are positioned such that the weight of the work platform 10 will urge the blade portion 67 against the stop 78 when the lifting arm 66 is in the engaged position 68. The worker 12 will position the work platform 10 in the desired position and then rotate each of the four lifting arms 66 to in turn lift the rollers 30 thereby disengaging them from the flange 16, hence, providing a steady Work platform 10 for the Worker 12 to work from.

The worker support structure 22 described previously, can include a plurality of suspension members 84 that hang from the transverse frame members 20 to support a lower deck 86. As shown in FIG. 2, the suspension members 84 have a lower end 88 and an upper end 90. In preferred form, the members 84 are formed from hollow tubing. The upper ends 90 of the suspension members 84 attach to the transverse beams 20 while the lower ends 88 of the suspension members 84 connect to and support a pair of spaced apart longitudinal deck support beams 92 that in turn support the deck 86. The deck 86 is therefore suspended at a location offset below the transverse frame members 20, such that in the case when the work site beam ribs 26 are shorter than the height of a worker, the deck 86 supporting the worker can be lowered so that the worker 12 is a more comfortable position.

Figure 11:
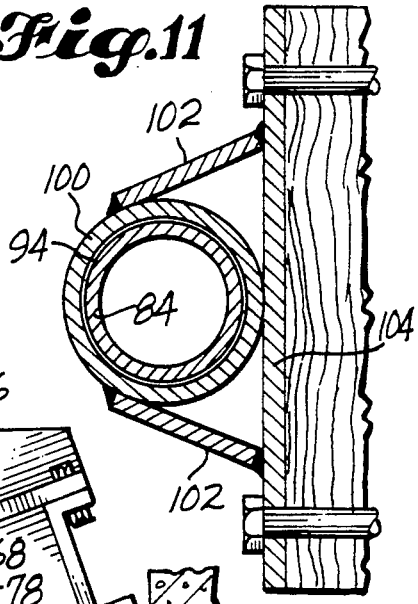
FIG. 11 is an enlarged scale sectional view taken substantially along line 11—11 in FIG. 7, showing a socket and suspension member in cross section and attachment bolts in top plan.

Referring now to FIG. 11, the suspension members 84 are connected to transverse frame members 20 by an upper socket 94, with one socket 94 for each suspension member 84. The suspension member being a tube or rod having a pin receiving opening 96 placed near the upper end 90 with a pin 98 being placed therethrough with the pin engaging a portion of the socket 94 thereby preventing the suspension member 84 from moving out of the socket 94. As shown in FIG. 11, the upper socket 94 includes a tubular portion 100, side braces 102 and the mounting plate 104 that are used to secure the socket 94 to a cross frame member 20. A plurality of lower sockets 106 are similar to the upper sockets 94 and are connected to a longitudinal deck support beams 92.

The lower end 88 of each suspension member 84 has a series of holes drilled therein that provide an adjustable connection for securing the lower ends of the suspension members from movement out from the lower sockets 106. By raising or lowering the deck 86 along with the support beams 92, the pins 108 can be moved to the appropriate holes thereby adjusting the level of the deck 86. The longitudinal deck support beams 92 include a portion 110, similar to the nailable member 60 in the transverse beams 20 (see FIG. 7), wherein a nail can be driven into portion 110. In this manner a plywood paneled deck 112 can be nailed directly to the longitudinal deck support beams 92.

The longitudinal deck support beams 92 are similar to the previously described transverse member 20. They are made of a pair of metal channels 114 having parallel webs and parallel flanges with the flanges directed outwardly with the nailable portion 110 sandwiched between the channels 114 with the sandwich usually being bolted together. The channels 114 include a pair of upper flanges 116 that support the deck wall 86.

Figure 10:
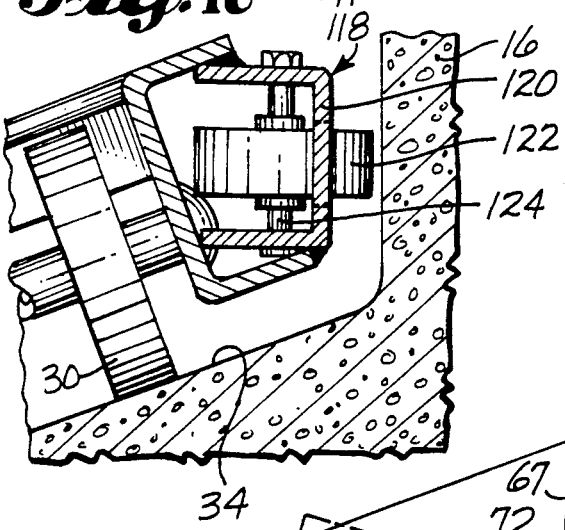
FIG. 10 is an enlarged scale sectional view taken substantially along line 10—10 of FIG. 4, showing a guide wheel assembly.

Referring now to FIG. 10, the side frame assemblies 20 may include a guide member 118. The guide member 118 includes a channel member 120 attached to each of the outer longitudinal beams 28 in such a manner as to hold a guide wheel 122, or other anti-friction device, perpendicular to the web 26 of the work site beam 14. The guide wheel or ball 122 acts to center the side frame assemblies 20 between work site beams 14. The guide wheel 122 is centered on an axle 124 that is connected to the channel member 120.

From the foregoing, there is further modifications, component arrangements, and modes of utilization of the invention will be apparent to those skilled in the art to which the invention is addressed. The scope of protection is not to be limited by the details of the embodiments which have been illustrated and described. Rather, the scope of protection is to be determined by the appended claims, interpreted in accordance with the established rules of patent claim interpretation.

What is claimed is:

1. A work platform adapted to be supported by and between a pair of spaced apart work site beams having inwardly directed confronting flanges, comprising:

a pair of elongated, laterally spaced apart side frame assemblies, each side frame assembly including a pair of spaced apart longitudinal beams, and a plurality of rollers between said longitudinal beams supported for rotation about parallel axes spaced apart longitudinally of the assembly;

transverse frame members extending between and interconnecting the side frame assemblies; and a worker support structure connected to the transverse frame members, wherein in use the side frame assemblies are positioned above the inwardly directed flanges of the work site beams, and the rollers are in platform supporting contact with the upper surfaces of the flanges, whereby the rollers mount the work platform for travel along the flanges, lengthwise of the work site beams, for moving the worker support structure lengthwise of the work site beams.

2. A work platform according to claim 1, wherein the rollers having a diameter which is closely equal to the depth of the longitudinal beams perpendicular to the upper surfaces of the work site beam flanges and said rollers are mounted so as to present peripheral portions below said longitudinal beams.

3. A work platform according to claim 2, comprising a plurality of axles which support the plurality of rollers for rotation, said axles extending between and being supported at their ends by the longitudinal beams.

4. A work platform according to claim 1, comprising a plurality of axles which support the plurality of rollers for rotation, said axles extending between and being supported at their ends by the longitudinal beams.

5. A work platform according to claim 4, comprising at least one roller on each axle, said roller being supported for rotation about the axle by an antifriction bearing, and tubular spacers on the axle for holding the roller in a predetermined position lengthwise of the axle.

6. A work platform according to claim 5, wherein the longitudinal beams include web portions extending substantially perpendicular to the upper surface of the work site beam flange and said axles are supported at their ends by said webs.

7. A work platform according to claim 6, wherein the rollers are closely equal in diameter to the dimension of the longitudinal beams perpendicular to the upper surface of the work site beam flanges and said rollers are offset downwardly, by the placement of the axles, so as to present peripheral portions below said longitudinal beams.

8. A work platform according to claim 1, wherein each side frame assembly includes at least one cross frame member extending between and connected at its ends to the longitudinal beams, for reinforcing the side frame assembly.

9. A work platform according to claim 8, comprising a plurality of axles which support the plurality of rollers for rotation, said axles extending between and being supported at their ends by the longitudinal beams.

10. A work platform according to claim 9, wherein the rollers are closely equal in diameter to the dimension of the longitudinal beams perpendicular to the upper surfaces of the work site beam flanges and said rollers are offset downwardly, by a placement of the axles, so as to present peripheral portions below said longitudinal beams.

11. A work platform according to claim 1, comprising a plurality of axles which support the plurality of rollers for rotation, said axles extending between and being supported at their ends by the longitudinal beams, and further comprising a longitudinal frame member which is positioned between and extends in parallelism with the longitudinal beams, said longitudinal frame member engaging the axles and providing intermediate support for the axles.

12. A work platform according to claim 1, comprising pivot connectors connecting the side frame assemblies to the transverse frame members, for pivotal movement of the side frame assemblies relative to the transverse frame members, about axes extending longitudinally of the work platform, so that the side frame assemblies will automatically assume a position placing the rollers into contact with the upper surfaces of the work site beam flanges.

13. A work platform according to claim 12, wherein each transverse frame member includes a portion at each end which includes a transverse pivot pin receiving opening, and said side frame assemblies include frame portions presenting pivot pin receiving openings which are alignable with the pivot pin receiving openings in said transverse frame members, and a pivot pin extends through each set of aligned openings, said pivot pins serving to pivotably mount the side frame assemblies onto the transverse frame members.

14. A work platform according to claim 13, wherein said frame portions include a pair of frame arms connected to the longitudinal beams of the side frame assemblies, and the end portions of the transverse frame members are positioned between said frame arms, and the aligned pivot pin openings are in said frame members.

15. A work platform according to claim 1, wherein the transverse frame members include a portion into which a nail can be driven, and said worker support structure comprises decking which is nailed to said portion.

16. A work platform according to claim 15, wherein said transverse frame members comprise a pair of metal channels having parallel webs which are directed inwardly and parallel flanges which are directed outwardly, and the portion in which a nail can be driven is positioned between the two webs.

17. A work platform according to claim 16, wherein each transverse frame member includes a pair of upper flanges, which are the flanges of the channel members, on which the decking is supported.

18. A work platform according to claim 1, further comprising means engageable for holding the work platform from travel along the flanges of the work site beams.

19. A work platform according to claim 18, wherein said means engageable comprises at least one lifting lever, said lifting lever being pivotally attached to the work platform and being movable between an inoperative position in which the rollers are down on the flange and an operative position in which it bears against the work site beam flange and lifts rollers up off from the flange.

20. A work platform according to claim 19, wherein said lifting arm includes a pivot connection to a side frame assembly, a cam portion on one side of the pivot connection and a control portion on the opposite side of the pivot connection, said work platform also including a stop against which the control portion moves when said lifting arm is in its operative position, said cam portion including a cam surface which is in lifting contact with the upper surface of a work site beam flange during a portion of the movement of the lifting arm from its inoperative position to its operative position and an adjacent holding surface which when the lifting arm is against the stop contacts the flange surface, with said stop being positioned where the platform weight will urge the lifting arm against the stop when the lifting arm is in its operative position.

21. A work platform according to claim 1, wherein the worker support structure includes a plurality of suspension members, each having a lower end and an upper end connected to said transverse frame members, and a pair of spaced apart longitudinal deck support beams connected to the lower ends of said suspension members, and a deck supported by said support beams at a location offset below the transverse frame members.

22. A work platform according to claim 21, wherein said transverse frame members include a plurality of upper sockets, one for each suspension member, with the upper end of each suspension member being received in one of said upper sockets, and connection means securing the upper ends of the suspension members from movement out from said upper sockets.

23. A work platform according to claim 21, comprising a plurality of lower sockets on said longitudinal deck support beams, one for each suspension member, with a lower end of each suspension member extending into one of the lower sockets, and adjustable connection means for securing the lower ends of the suspension members from movement out from said lower sockets, for adjusting the amount of offset of the deck below the transverse frame members.

24. A work platform according to claim 21, wherein the longitudinal deck support beams each includes a portion into which a nail can be driven, and said deck is nailed to said portion.

25. A work platform according to claim 24, wherein each longitudinal deck support beam comprises a pair of metal channels having parallel webs which are directed inwardly and parallel flanges which are directed outwardly, and the portion in which a nail can be driven is positioned between the two webs.

26. A work platform according to claim 25, wherein each longitudinal deck support beam includes a pair of upper flanges, which are the flanges of the channel members, and said deck is supported on said upper flanges.

27. A work platform adapted to be supported by and between a pair of spaced apart work site beams of a type having vertical webs and laterally inwardly directed lower flanges presenting confronting flange edges separated by an open space, comprising:

a pair of laterally spaced apart carriages, each carriage including a plurality of rollers;

transverse frame members extending between and interconnecting the carriages, each said transverse member being connected at its ends to said carriages, each said connection being located over one of said work site beam flanges laterally between a flange edge and the web of a work site beam;

a worker support structure connected to the transverse frame members;

wherein in use the carriages are positioned above the work site beam flanges and the rollers are in platform supporting contact with the upper surfaces of the flanges, and whereby the rollers mount the work platform for travel along the flanges, for moving the worker support structure lengthwise of the work site beams.

28. A work platform according to claim 27, including transverse frame members having a plurality of transversely spaced apart pivotable connection points adjacent their ends, said pivotal connections provide transverse spacing of the carriages to closely match the open space between the work site beams.

29. A work platform according to claim 27, comprising a guide member attached to said work platform, said guide member acting to center the work platform for travel along the flanges.

30. A work platform according to claim 29, wherein said guide member includes a plurality of guide wheels attached to ends of the carriages, said guide wheels having their axes of rotation generally parallel to the vertical webs of the work site beams.

* * * * *

UNITED STATES PATENT AND TRADEMARK OFFICE
CERTIFICATE OF CORRECTION

PATENT NO. : 5,048,640

DATED : September 17, 1991

INVENTOR(S) : James J. McConville and Allen Jett

It is certified that error appears in the above-identified patent and that said Letters Patent is hereby corrected as shown below:

On the title page, under "INVENTORS", "Allen Jeff" should be -- Allen Jett --.

Col. 3, line 50, after "parts", insert -- throughout --.

Col. 3, line 53, delete the comma after "the".

Col. 3, line 59, insert -- performing -- before "work".

Col. 3, line 67, insert -- portions -- after "with".

Col. 4, line 12, after "support", insert -- axle and three --.

Col. 6, line 10, there is a period after "assemblies 18".

Col. 8, line 2, "Work" should be -- work -- and "Worker" should be -- worker --.

Signed and Sealed this

Twenty-third Day of February, 1993

*Attest:*

STEPHEN G. KUNIN

*Attesting Officer*

*Acting Commissioner of Patents and Trademarks*